United States Patent [19]

Deveaux

[11] 4,388,334

[45] Jun. 14, 1983

[54] MOULD FOR PACKAGING DESSERTS

[75] Inventor: Rene Deveaux, Le Raincy, France

[73] Assignee: Societe d'Assistance Technique pour Produits Nestle S.A., Lausanne, Switzerland

[21] Appl. No.: 325,219

[22] Filed: Nov. 27, 1981

Related U.S. Application Data

[62] Division of Ser. No. 158,783, Jun. 12, 1980, abandoned.

[30] Foreign Application Priority Data

Jun. 22, 1979 [FR] France ..... 79 16059

[51] Int. Cl.[3] ..... A23G 1/20; A23G 9/00; B65D 85/72

[52] U.S. Cl. ..... 426/112; 249/119; 249/121; 249/127; 249/140; 426/90; 426/100; 426/101; 426/103; 426/115; 426/130; 426/393; 426/515; D7/43; 426/132

[58] Field of Search ..... 426/100, 101, 112, 115, 426/130, 393, 515, 89, 90, 91, 104, 103, 106, 120, 306, 383, 132; 249/92, 121, 119, 140, 127; D7/43; D1/99

[56] References Cited

U.S. PATENT DOCUMENTS

| | | | |
|---|---|---|---|
| D. 117,347 | 10/1939 | Brickley | D7/43 |
| D. 195,601 | 7/1963 | Bostrom | D7/43 |
| 2,005,245 | 6/1935 | Stover | 426/101 |
| 2,038,575 | 4/1936 | Krein | 426/130 |
| 2,104,805 | 1/1938 | Krein | 426/101 |
| 2,235,964 | 3/1941 | Meyer et al. | 426/130 |
| 3,244,537 | 4/1966 | Cease | 426/393 |
| 3,529,976 | 9/1970 | Peters | 426/130 |
| 3,680,828 | 8/1972 | Swett | 249/104 |
| 3,799,493 | 3/1974 | Beck et al. | 249/104 |
| 3,976,796 | 8/1976 | Peters | 426/115 |
| 4,165,061 | 8/1979 | Kupperman | 249/92 |
| 4,225,623 | 9/1980 | Stussi | 426/130 |

OTHER PUBLICATIONS

Wagner Ware Cat. #30, 1924, p. 22.

*Primary Examiner*—Steven L. Weinstein
*Attorney, Agent, or Firm*—Vogt & O'Donnell

[57] ABSTRACT

The invention relates to a mould for packaging desserts, particularly for ice-cream cake with coating syrup containing fruit or pieces of fruit. The mould is in the form of a cup comprising an opening through which the dessert is introduced into and removed from the mould and is characterized in that it comprises a first compartment near the opening which defines a first space and which is intended to receive a product solid at the storage temperature and a second compartment which defines a space below the first space and which is intended to receive a syrup liquid at the storage temperature, the second compartment comprising a central part situated at the bottom of the cup and communicating with the first compartment through an opening and a peripheral part which consists of circumferentially spaced grooves or depressions arranged in a star around the central part and which forms a flow channel for the syrup and also acts as a stiffener for the mould.

7 Claims, 3 Drawing Figures

MOULD FOR PACKAGING DESSERTS

This is a division of application Ser. No. 158,783, filed June 12, 1980, now abandoned.

This invention relates to the packaging of desserts and, more particularly, to the packaging of ice-creams, ices, sorbets or the like comprising a coating syrup containing fruit or pieces of fruit. The present trend in the field of desserts, particularly ice-cream cake, is to provide the consumer with a ready-made product, for example an ice-cream cake with coating syrup which may be directly prepared by removal from the packaging mould.

Packs for products of this type are already known. However, it is generally necessary, after removing the ice-cream cake from the mould, separately to coat it with a syrup which has itself been separately packaged.

One-piece packs have also been proposed, comprising a first compartment which receives the ice-cream and a second compartment which contains the syrup. However, these known packs are generally in the form of individual portions.

However, it would be desirable to make available to the public a pack of fairly large size, for example a family-size pack, for an ice-cream cake with coating syrup containing fruit or pieces of fruit. However, this involves difficulties, particularly during the filling operation, because a distinct separation is required between the syrup and the ice-cream. During production, the mould with its opening facing upwards is initially filled with syrup to a certain level, the filling then being completed by the ice-cream. If the dimensions of the mould and the compartments are large it then becomes very difficult to obtain a distinct separation between the ice-cream and the syrup.

In addition, it is desirable that, during removal from the mould, the fruit or pieces of fruit should not be scattered at random at the bottom of the cake, but should be situated on the top of the cake whilst the syrup flows along its sides, thereby achieving a better effect from the point of view of presentation.

The pack according to the invention obviates these difficulties and enables these requirements to be satisfied.

Accordingly, the invention provides a mould for packaging desserts, particularly ice-cream cake with coating syrup containing fruit or pieces of fruit, in the form of a cup comprising an opening through which the dessert is introduced into and removed from the mould, the mould comprising a first compartment near the opening which defines a first space and which is intended to receive a product solid at the storage temperature and a second compartment which defines a space below the first space and which is intended to receive a syrup liquid at the storage temperature, the second compartment comprising a central part situated at the bottom of the cup and communicating with the first compartment through an opening and a peripheral part which consists of circumferentially spaced grooves or depressions arranged in a star around the central part and which forms a flow channel for the syrup and also acts as a stiffener for the mould.

In one preferred embodiment of the mould according to the invention, the side wall of the cup is corrugated and comprises 6 to 12 festoons, whilst the second compartment comprises a cylindrical centrall cell and 6 to 12 grooves which act as flow channels for the syrup and which are distributed around the periphery of the central cell, their shape matching that of the lateral festoons. The base of the mould is thus in the form of a central cell surrounded by radial grooves.

These grooves communicate with the central cell and form as many pockets of syrup.

That part of the first compartment of the cup which faces the opening of the cup forms a ledge parallel to the edge of the cup between the grooves.

This arrangement has the following advantages:

It enables the syrup pocket to be partitioned off, thus increasing its imperviousness during the storage and distribution period.

It enables, the pressure of the ice-cream on the surface of the syrup during the filling process to be divided, thus avoiding random penetration during distribution of the still soft ice-cream in the container.

It enables the appearance of the product on removal of the mould to be improved by impressing on the surface of the ice-cream a pattern which matches that of the lateral festoons. Finally, it facilitates the flow of the syrup along the sides of the ice-cream during its removal from the mould and, when the syrup contains fruit or pieces of fruit, it keeps the fruit or pieces of fruit on the top of the cake, the width of the channels being smaller than the dimensions of the fruit or pieces of fruit.

In its preferred form, the mould has a diameter at the level of the opening of from 150 to 200 mm, the thickness of the syrup pocket is from 7 to 18 mm, the volume of the central part of the syrup pocket is from 18 to 60 whilst the respective volumes of syrup and ice-cream are from 75 to 180 ml per 1000 ml.

The syrup used to coat the ice-cream cake preferably contains whole fruit or pieces of fruit, for example: currants, black currants, bilberries, pieces of cherry, strawberry, apple, pear, lemon etc. The pieces of fruit or the whole fruit are preserved, semi-preserved or impregnated with alcohol.

In one preferred embodiment, the fruit has been subjected to a treatment which enables it immediately to assume a consistency suitable for its consumption whilst, at the same time, retaining the appearance and texture of fresh fruit without any need for preliminary heating. This raises a particular problem, because fruit of the type generally used in food becomes hard and inedible if stored at a temperature of −30° C. To provide it with the necessary softness at −20° C. without having to preserve it, the fruit is subjected to hot impregnation with a sugar solution, followed by cooling. Before this treatment, the fruit may either be fresh fruit or deep-frozen fruit (berries) or dehydrated or freeze-dried and rehydrated fruit (pieces of apple or strawberry). The syrup used for coating should have a consistency at −20° C. which is sufficient not to cause any problems of premature flow during storage and transport. On the other hand, it should be capable of reassuming a suitable fluidity at the moment of use by gentle heating. The syrup may be either a mixture of fruit juice and sugar or a caramel or even a flavoured syrup, for example a coffee-flavoured or chocolate-flavoured syrup, of suitable viscosity. A good covering of the ice is obtained with a mixture containing from 30 to 50% of berries or cubes of fruit and from 50 to 70% by weight of coating syrup. The quantity of fruit/syrup mixture used depends on the surface area of the piece of ice-cream to be coated and preferably corresponds to 0.25 to 0.50 ml of mixture per $cm^2$ of surface to be covered.

The mould according to the invention may be used for all kinds of congealable products made in moulds other than ice-creams, such as caramel puddings, semolina puddings, rice pudding, jellies with syrup, mousses with syrup, etc. However, it is pointed out that, for any product packaged at low temperature or undergoing a heat treatment at a temperature below 120° C. after packaging, the mould is best made of a plastics material. It is possible to use any food-grade heat-formable plastics material such as, for example, polyvinyl chloride, polypropylene, polyethylene, polystyrene, etc.

For a product undergoing a heat treatment at a temperature of or above 120° C., it will be advantageous to use stamped aluminium.

The material used should be of such a thickness that it is sufficiently rigid whilst at the same time having the flexibility required to facilitate removal from the mould. In addition, it should be capable of withstanding prolonged storage at low temperatures.

The features and advantages of the invention will become apparent from the following description in conjunction with the accompanying diagrammatic drawings given by way of example, wherein.

Figure 1:
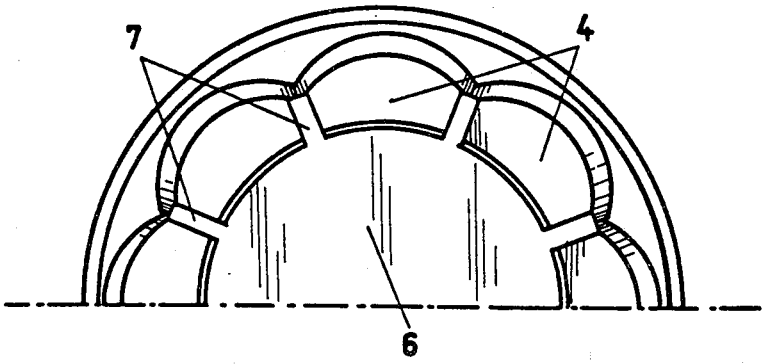
FIG. 1 is a semi-plan view.
Figure 2:
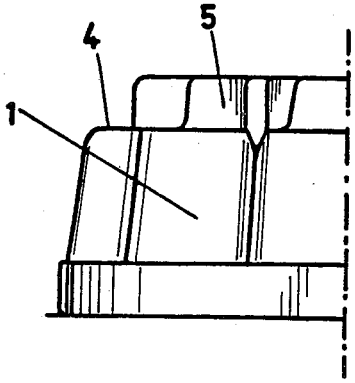
FIG. 2 is a semi-elevation.
Figure 3:
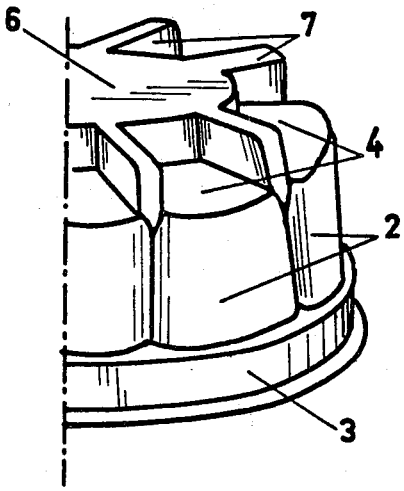
FIG. 3 is a semi-isometric projection of the mould.
Figure 2:
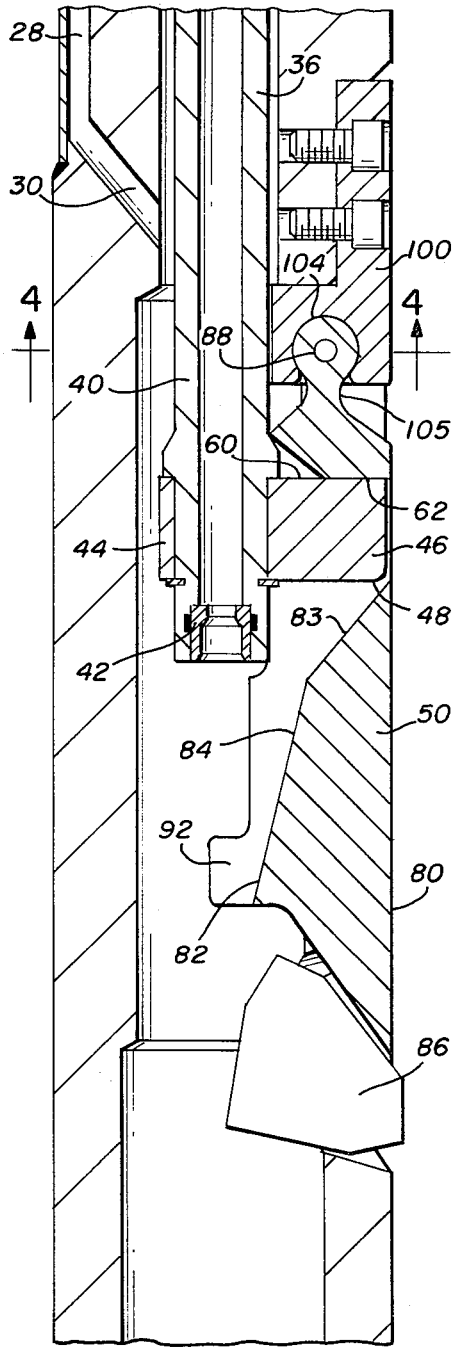
Figure 3:
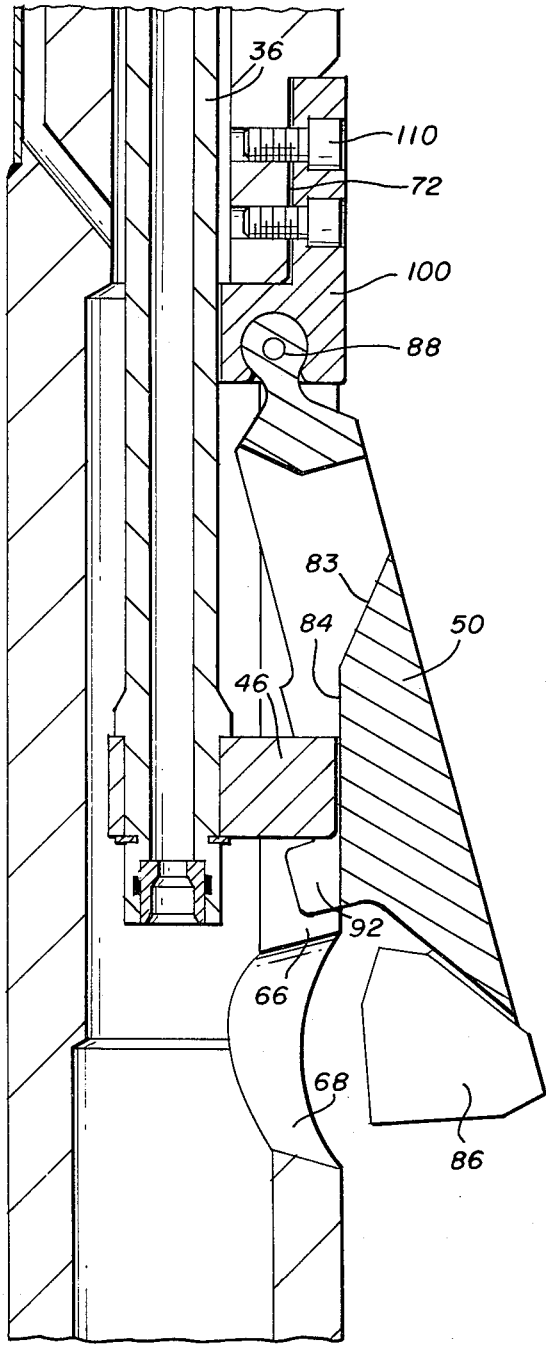

Generally and as can be seen from the drawings, the pack according to the invention comprises a first compartment 1 of which the lateral wall is provided with festoons 2 and the widest part with a base 3. The first compartment is provided with a ledge 4. This compartment is intended to receive that part of the dessert which is solid at the storage temperature, for example ice-cream. This mould comprises a second compartment 5 which is intended to receive that part of the dessert which is liquid at its storage temperature, for example the coating syrup. This second compartment is formed by a central cell or depression 6 and grooves or depressions 7 arranged radially around the cell 6. These grooves divide the syrup pocket and act as stiffeners for the base of the mould.

The mould may be made in one piece of a thermoplastic material by forming or extrusion or, in the case of aluminium, by stamping.

For filling, the mould is arranged with its opening facing upwards. The pocket of the base (6 and 7) is then filled either with the syrup alone or, preferably, with the mixture of syrup and fruit.

The mould is then directed towards a filling station which introduces the ice-cream at a temperature of between −3° and −8° C. by flow or by extrusion into the first compartment 1.

It is possible to use one or more types of ice-cream, water ice, mousse or any suitable type of cream. If several types are present, they may be arranged either in the form of superposed layers or in the form of concentric rings or in the form of radial sections.

At the moment of use, the mould is inverted and heated so that the ice-cream detaches itself from the mould and the coating syrup flows along its sides, for example on a plate. However, when the product accomodated in the first compartment is not frozen or has a certain plasticity, for example in the case of a pudding, it may be removed from the mould by simple deformation thereof. If fruit is present in the syrup, it is retained within the cell 6 and remains at the top of the cake after removal from the mould. A projection may also be provided around the periphery of the ledge 4 as an additional means of retaining the fruit on the surface of the cake.

I claim:

1. A packaged dessert comprising:

(a) a mould having a wall structure including a bottom wall and a side wall extending from said bottom wall at the periphery thereof, said bottom wall and said side wall cooperatively defining a cup-like first space, said wall structure defining an opening at the mouth of said cup-like first space remote from said bottom wall, said bottom wall having both a central depression open to said first space remote from said side wall and a plurality of circumferentially spaced elongated grooves or depressions open to said first space extending outwardly from said central depression towards said sidewall and in fluid communication with said central depression, said depression and said grooves cooperatively defining a second space communicating with said first space;

(b) a congealable product solid at the storage temperature of the dessert disposed in said first space; and (c) a syrup disposed in said second space; the portions of the bottom wall between said circumferentially spaced elongated grooves or depressions supporting said congealable product during filling and storage to prevent mixing of said congealable product and said syrup; said circumferentially spaced elongated grooves or depressions channeling said syrup to the sides of said congealable product during removal of the dessert from the mould.

2. A packaged dessert as claimed in claim 1, wherein said side wall is corrugated and comprises from 6 to 12 festoons.

3. A packaged dessert as claimed in claim 2 wherein the outer end of each of said grooves or depressions is aligned with a point on said side wall between adjacent ones of said festoons.

4. A packaged dessert as claimed in claim 3 wherein each of said grooves or depressions extends to said side wall.

5. A packaged dessert as claimed in claim 1 wherein said syrup is present in a quantity of from 75 to 180 parts per 1000 parts by volume of said solid congealable product.

6. A packaged dessert as claimed in claim 1 wherein said wall structure defines an edge surrounding said opening, the surface of said bottom wall facing toward said first space between said grooves or depressions being flat and parallel to said edge.

7. A packaged dessert as claimed in claim 1 or claim 4 or claim 5 further comprising pieces of fruit disposed in said central depression, the width of each of said grooves or depressions being smaller than the smallest dimension of each of said pieces of fruit.

* * * * *

UNITED STATES PATENT AND TRADEMARK OFFICE

CERTIFICATE OF CORRECTION

PATENT NO. : 4,388,334

DATED : June 14, 1983

INVENTOR(S) : Rene Deveaux

It is certified that error appears in the above—identified patent and that said Letters Patent is hereby corrected as shown below:

Change "Sheet 1 of 2" to --Sheet 1 of 1--.

Delete in its entirety the page of drawings denominated "Sheet 2 of 2".

At Column 2, line 32, insert --ml-- after "60".

Signed and Sealed this

*Ninth* Day of *August 1983*

[SEAL]

*Attest:*

GERALD J. MOSSINGHOFF

*Attesting Officer*

*Commissioner of Patents and Trademarks*